United States Patent [19]

Donato

[11] 4,087,776

[45] May 2, 1978

[54] ACCELERATOR SWITCH ASSEMBLY

[75] Inventor: Guido A. Donato, Wayne, Pa.

[73] Assignee: Drexel Industries, Inc., Horsham, Pa.

[21] Appl. No.: 753,411

[22] Filed: Dec. 22, 1976

[51] Int. Cl.[2] ..... H01C 10/50

[52] U.S. Cl. ..... 338/198; 74/478; 74/512; 74/513; 200/153 LB; 318/257; 318/260; 338/153

[58] Field of Search ..... 338/67, 153, 172, 179, 338/191, 198, 200; 200/153 LB, 61.89, 86.5; 74/478, 512, 513; 180/DIG. 3, 77 R, 65 R; 318/139, 257, 260, 263

[56] References Cited

U.S. PATENT DOCUMENTS

| | | | |
|---|---|---|---|
| 3,432,791 | 3/1969 | Palmer | 338/198 |
| 3,833,782 | 9/1974 | Bartel | 338/153 X |
| 4,047,145 | 9/1977 | Schwehr | 338/67 |

*Primary Examiner*—C. L. Albritton
*Attorney, Agent, or Firm*—Paul & Paul

[57] ABSTRACT

A control box is provided having a control shaft which projects from the box and is adapted to be connected, directly or by linkage, to the accelerator pedal of a battery-operated motor vehicle. Connected to the inward end of the control shaft is the movable arm of a potentiometer which is moved angularly to change the circuit resistance when the accelerator pedal is depressed. Mounted on the control shaft are a pair of cams, the followers rollers of which actuate a pair of microswitches which control a solid-state control system which controls the current delivered by the battery to the traction motor of the vehicle.

8 Claims, 6 Drawing Figures

ACCELERATOR SWITCH ASSEMBLY

BACKGROUND OF THE INVENTION

This invention relates to battery operated vehicles and particularly to control means for controlling the battery-operated traction motor to provide for a smooth control of speed.

SUMMARY OF THE INVENTION

A principal purpose of the present invention is to provide a control box, containing a simplified accelerator switch assembly, adapted to be installed in a battery-powered motor vehicle, such as a fork lift truck, or golf cart, or electric automobile, and having projecting from the box a control shaft adapted to be connected, directly or through linkage, to the accelerator pedal for providing, in response to movement of the accelerator pedal, smooth control of vehicle speed.

DETAILED DESCRIPTION OF THE PREFERRED EMBODIMENTS

Figure 2:
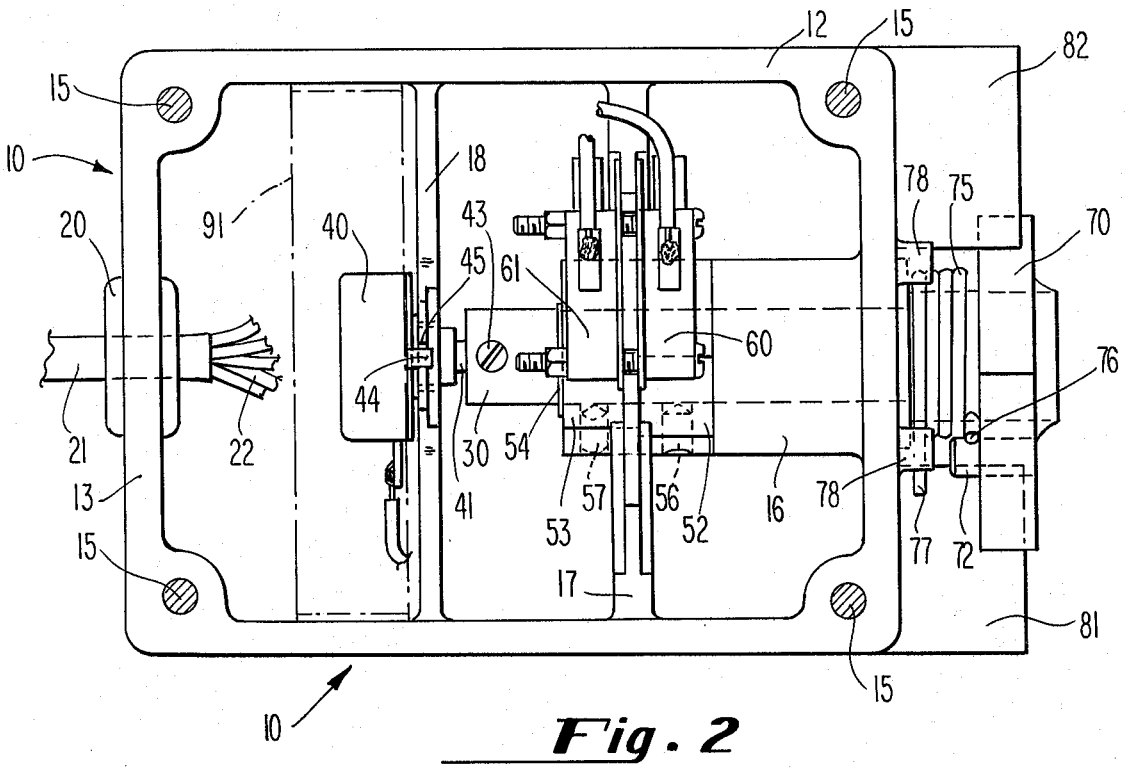
FIG. 2 is a plan view looking down along the line 2—2 of FIG. 1.

Referring now to drawings, an accelerator switch assembly according to the present invention is housed in a rectangular box 10 having a front wall 12 and a rear wall 13. A cover plate 14 is secured to box 10 as by four corner screws 15. Projecting inwardly from front wall 12 is a relatively large boss 16. A circular hole extends through the front wall 12 and through the boss 16 and into this hole a bushing 27 is inserted. Bushing 27 has an outer flange which abuts against the face of front wall 12. Extending through the central bore of bushing 17 is an elongated tubular control shaft 30. Control shaft 30 extends inwardly through an opening **17*a* in an arch-like mounting panel 17, best seen in FIG. 3, which extends between the sidewalls of the control box 10**.

Mounted on control shaft 30 are a pair of cams 52 and 53. These cams are so positioned that cam 52 is on one side of the mounting panel 17 and cam 53 is on the other side. Secured to the upper bridge portion of panel 17, as by screws, are a pair of microswitches 60 and 61, with microswitch 60 on one side of panel 17 and microswitch 61 on the other side. A pair of cam-follower rollers 62 and 63 rest on the cam surfaces of cams 52 and 53, respectively, and are connected respectively to microswitches 60 and 61. Cams 52 and 53 are retained on control shaft 30 by a retainer ring 54 which retains the cams in position between the ring 54 and the boss 16.

Figure 4:
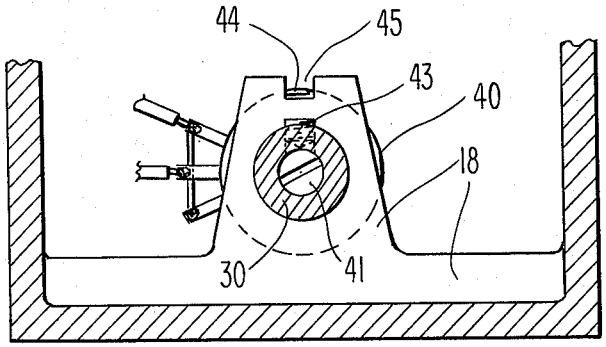
FIG. 4 is an end view, in section, looking along the line 4—4 of FIG. 1.

A potentiometer 40 is supported in a mounting bracket 18 which, as seen best in FIG. 4, extends across the control box 10 from one sidewall to the other. Mounting bracket 18 has therein a central hole which receives an enlarged portion 42 of the potentiometer shaft 41. Shaft 41 extends into the inward end of the central bore of the tubular control shaft 30 and is secured by a headless set screw 43 which is inserted into a tapped hole in the wall of the tubular control shaft 30. Set screw 43 serves as a means for adjusting the angular position of the potentiometer shaft 41 relative to that of control shaft 30, thereby permitting calibration of the potentiometer.

As seen best in FIG. 4, the center portion of mounting bracket 18 projects upwardly above the housing of the potentiometer 40. In the uppermost edge of mounting bracket 18 is a notch 45 which receives a finger 44 which projects forwardly from the housing of potentiometer 40. The width of notch 45 is somewhat greater than the width of finger 44, so that the potentiometer housing is not rigidly secured to the mounting bracket 18. There is room for a small amount of angular play between the potentiometer housing and mounting bracket 18.

The tubular control shaft 30 projects forwardly from front wall 12 of control box 10. Mounted on the forward end of the projecting control shaft 30 and secured thereto, as by welding, is a lever 70 which is pivotal on control shaft 30. In its rest position, lever 70 projects upwardly at an inclined angle from shaft 30. Inserted through an upper portion of lever 70 is a bushing 71 which receives a linkage which connects lever 70 to the accelerator pedal (not shown) of the fork-lift truck or other vehicle, so that when the accelerator pedal is depressed the lever 70 is moved angularly thereby to move angularly in a corresponding manner the control shaft 30 and also the potentiometer shaft 41.

Lever 70 is biased to its rest or "off" position by means of a torsion spring 75, one end 76 of which is retained by a retaining pin 72 and the other end 77 of which is retained by a boss 78 which projects forwardly from the face of forward wall 12 of box 10. As viewed looking from right to left in FIGS. 1 and 3, lever 70 is biased in the counterclockwise direction. Also projecting forwardly from the lower part of front wall 12 of box 10 are a pair of spaced-apart limit arms 81 and 82, one on either side of control shaft 30. One of these arms, arm 82 in the present example, functions as a limit stop against which the lower right edge of lever 70 abuts when the accelerator pedal is not depressed and lever is biased to its rest or "off" position. The other arm 81 functions as a limit stop against which the lower left edge of lever 70 abuts when the accelerator pedal is fully depressed and lever 70 is in its fully "on" position. The inward edges of limit arms 81 and 82 are inclined at angles corresponding to those of the side edges of lever 70 when lever 70 is in its "off" and "on" limiting positions.

It is pointed out that lever 70 may be replaced by the accelerator pedal itself which may be secured directly to the forward end of control shaft 30.

Figure 3:
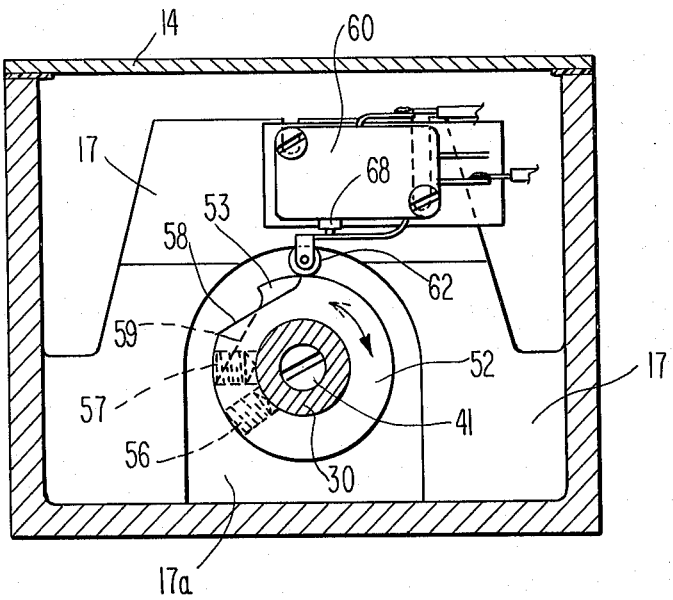
FIG. 3 is an end view, in section, looking along the lines 3—3 of FIG. 1.

As seen in FIG. 3, the positions of cams 52 and 53 relative to each other and to control shaft 30 are adjustable as by headless set screws 56 and 57. Cam 52 is used for actuating limit microswitch 60. This is the start switch which controls the initial feeding of current from the battery of the vehicle to the traction motor. The other cam 53 actuates limit switch 61 which in the present case is employed to shunt out the control circuit including potentiometer 40 so that the full voltage of the battery is applied directly to the traction motor of the vehicle.

Suitable electrical connections are provided. In the control box illustrated in the drawing, a circular opening is provided in the rear wall 13 of box 10. Inserted in this opening is an insulating grommet 20 through which passes a multi-conductor cable 21. Conductors 22 of cable 21 terminate at terminals 23 on the rearward side of a terminal strip 24 which is supported on a bridge 91 which extends from one sidewall of box 10 to the other.

A plurality of conductors 25 extend from terminals 26 on the other side of the terminal strip 24 to the potentiometer 40 and to the microswitches 60 and 61. The microswitches 60 and 61 are insulated from each other by insulators 66, one on each side of panel 17. While box 10 may take any suitable form, it may preferably be of cast aluminum, having as integral parts of the casting a pair of forwardly extending limit arms 81, 82, a pair of forwardly-extending spring retainer bosses 78, a large rearwardly extending shaft-supporting boss 16, an arch-like bridge panel 17 on which the microswitches are mounted, a mounting bracket 18 on which the potentiometer 40 is mounted, and four inward corner bosses which are tapped for receiving the screws 15.

Figure 1:
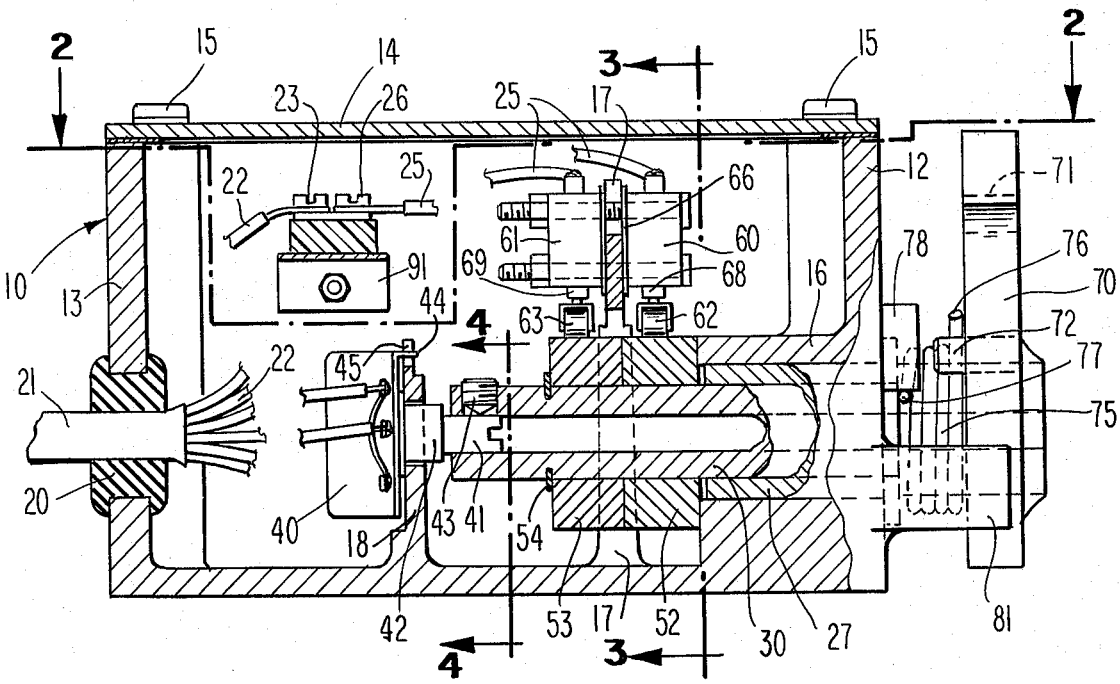
FIG. 1 is a side view, in section, of a control box containing an accelerator switch assembly according to the present invention.

In operation, when the accelerator pedal (not shown) is first depressed by the operator, lever 70 is moved angularly, clockwise as viewed from right to left in FIGS. 1 and 2 of the drawing. This angular movement of lever 70 rotates or angularly moves control shaft 30, cams 52 and 53 which are secured thereto, potentiometer shaft 41, and the movable arm (not shown) of the potentiometer. As will be seen from FIG. 3, as soon as cam 52 is moved angularly clockwise the cam follower roller 62 drops downwardly onto the flat 58 of cam 52 thereby allowing switch 68 to move downwardly, thereby actuating microswitch 60. This has the effect of allowing current to flow from the vehicle battery through the resistance element of potentiometer 40 and through solid-state control circuitry to the traction motor.

As the accelerator pedal is further depressed, the resistance of potentiometer 40 is correspondingly decreased until a point is reached at which cam follower roller 63 of second cam 53 drops onto the flat 59 of cam 53, thereby allowing switch 69 of microswitch 61 to drop down, thereby actuating limit switch 61. This has the effect of shunting or by-passing the control circuitry, including potentiometer 40, and allowing the full voltage of the vehicle battery to be impressed across the traction motor. By the means just described, a smooth control of the speed of the vehicle is achieved. Such smooth control of speed is important not only in forklift vehicles, but in electric vehicles generally.

Figure 5:
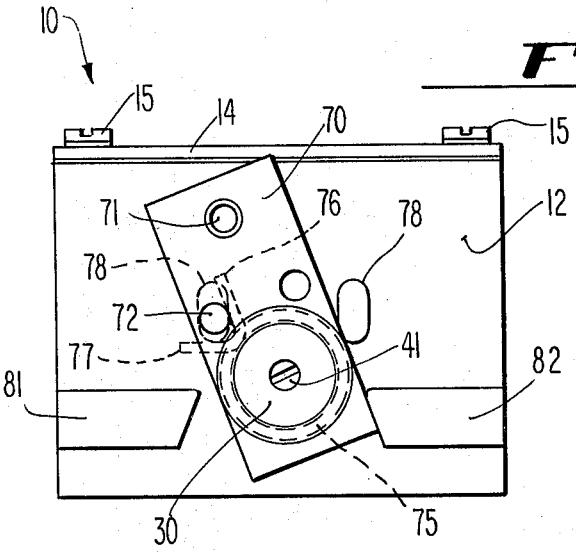
FIG. 5 is a front end view of the control box.
Figure 6:
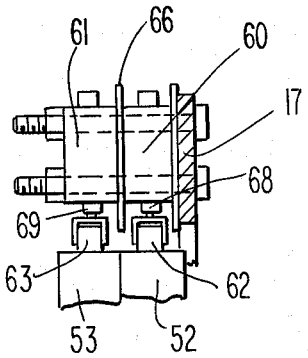
FIG. 6 shows a modification of the mounting of the cam-operated microswitches.

FIG. 5 illustrates a slight modification in which the two cams 52 and 53, the two switches 60 and 61, and the two cam followers 62 and 63, are all on one side of the supporting panel 17.

In describing the accelerator switch assembly control box, it has been assumed that the control box is installed on the left side of the accelerator pedal. It should be understood, however, that the control box is also readily adapted for installation on the right side of the accelerator pedal. To make such right side installation, a few changes have to be made. The torsion biasing spring 75 has to be reversed. To reverse spring 75, retaining pin 72 is removed from its hole at the left side of the lever 70, as viewed in FIG. 5, and placed in a corresponding hole at the right side of the lever 70. Retaining pin 72 in the right hand position retains one end of spring 75 and the other end of the spring is retained by the right boss 78. With spring 70 reversed, as just described, lever 70 in its "off" position is biased clockwise to a limit position in which the lower part of its left edge, as viewed in FIG. 5, abuts against the inclined inner edge of the left stop arm 81. When the accelerator pedal is fully depressed, the lever 70 is moved counterclockwise to a limit position in which the lower right edge of lever 70 abut against the right stop arm 82. The only other change that need be made, to convert to right side installation, is an internal change at terminal strip 24.

What is claimed is:

1. In a battery-powered mobile vehicle having a traction motor and a pivotal accelerator lever for controlling the speed of the motor, the improvement which comprises the provision of an accelerator switch assembly adapted to be connected to the accelerator lever, said switch assembly comprising:

a. a box-like housing having an opening in the front wall thereof;

b. an elongated rotatable tubular control shaft in said housing having a forward portion which extends outwardly through said front wall opening;

c. a floating potentiometer having a housing and a rotatable shaft extending into the center bore at the inward end of said tubular control shaft, whereby said potentiometer is floatingly mounted on said control shaft;

d. limit stop means for limiting movement in the rotational direction of the potentiometer housing relative to the switch-assembly housing;

e. set screw means for adjustably fixing the angular position of said potentiometer shaft relative to said control shaft;

f. first and second cams adjustably mounted on the exterior surface of said control shaft between its inward end and the front wall of said housing;

g. first and second cam-follower rollers engaging respectively the cam surfaces of said first and second cams;

h. first and second switches mounted in said switch assembly housing;

i. lever means connecting said first and second switches respectively to said first and second cam-follower rollers; and j. an accelerator lever mounted on and secured to the outward end of said control shaft and adapted to be moved pivotally for moving said control and potentiometer shafts angularly, thereby to change the setting of said potentiometer and to actuate said first and/or second switches.

2. Apparatus according to claim 1 wherein torsion spring means are provided on said control shaft for biasing said lever toward a predetermined "off" limit position.

3. Apparatus according to claim 2 wherein stop limit means are provided for limiting the angular movement of said control shaft in both the clockwise and counterclockwise directions.

4. Apparatus according to claim 3 wherein said stop limit means comprises a pair of spaced-apart projections which project forwardly from said control box and positioned in the path of angular movement of said accelerator lever.

5. Apparatus according to claim 1 wherein said first and second switches are mounted on an arch-like panel which spans said housing from sidewall to sidewall, with said control shaft passing through the opening of the arch.

6. Apparatus according to claim 1 wherein said cam-follower rollers are suspended from said switches and when moved by said cams are adapted to actuate said switches.

7. Apparatus according to claim 6 wherein said housing includes a terminal strip and means supporting said terminal strip.

8. Apparatus according to claim 7 wherein bracket means are provided within said housing for mounting said potentiometer in a position coaxial with the center axis of said control shaft.

* * * * *